US005242591A

United States Patent [19]

Beechert et al.

[11] Patent Number: 5,242,591

[45] Date of Patent: Sep. 7, 1993

[54] APPARATUS FOR FILTERING OPEN DRAINS

[76] Inventors: Kevin J. Beechert, 1728 NE. 148th, Seattle, Wash. 98155; John C. Nolan, Jr., 6332 40th Ave. SW., Seattle, Wash. 98136

[21] Appl. No.: 725,981

[22] Filed: Jul. 5, 1991

[51] Int. Cl.[5] ..... B01D 24/00

[52] U.S. Cl. ..... 210/474; 210/477; 210/483

[58] Field of Search ..... 210/455, 474, 473, 477, 210/482, 483; 55/12; 52/11, 12, 15; 156/148

[56] References Cited

U.S. PATENT DOCUMENTS

| | | | |
|---|---|---|---|
| 643,747 | 2/1900 | Martin | 52/12 |
| 2,120,395 | 6/1938 | Dean | 210/474 |
| 2,533,402 | 12/1950 | Schmitz, Jr. | 52/12 |
| 3,023,544 | 3/1962 | Hughes | 52/12 |
| 3,077,055 | 2/1963 | Tripp, Jr. | 52/12 |
| 3,151,962 | 10/1964 | O'Dell | 210/483 |
| 3,855,132 | 12/1974 | Dugan | 52/12 |
| 4,841,686 | 6/1989 | Rees | 210/474 |
| 4,949,514 | 8/1990 | Weller | 52/12 |
| 4,976,812 | 12/1990 | McConnell et al. | 156/148 |
| 5,103,601 | 4/1992 | Hunt | 52/12 |

*Primary Examiner*—Robert A. Dawson
*Assistant Examiner*—Sun Uk. Kim
*Attorney, Agent, or Firm*—Michael J. Folise

[57] ABSTRACT

A method and apparatus for filtering open drains, such as rain gutters, uses at least one elongated tube constructed from a plurality of strands of flexible, resilient, durable, corrosion resistant material. An affixing system removably affixes each of the elongated tube in the open drain. A method and a kit for filtering open drains also are disclosed.

5 Claims, 4 Drawing Sheets

FIG. 7
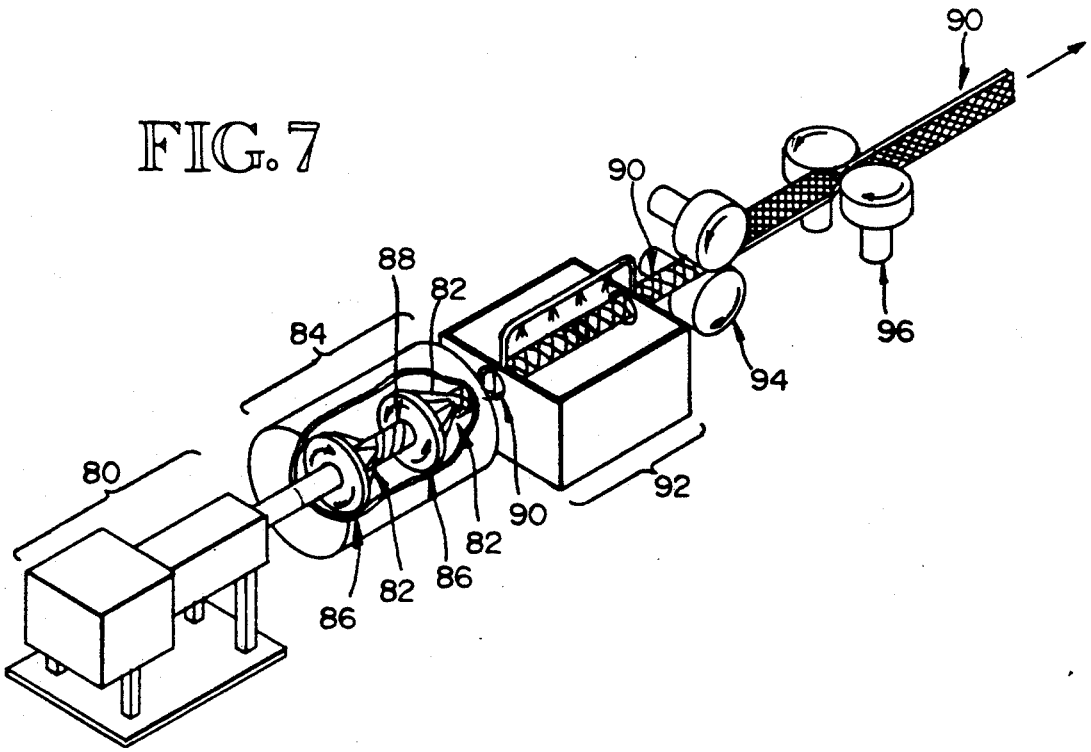
FIG. 8
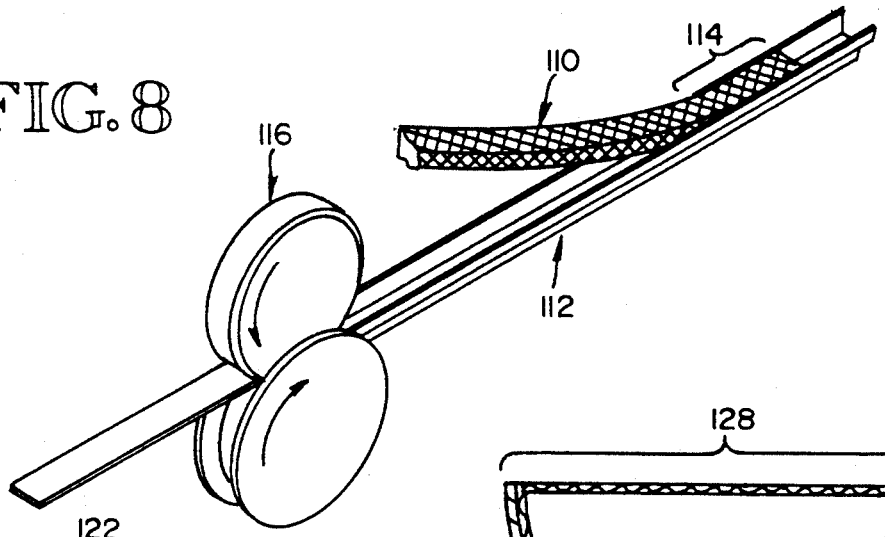
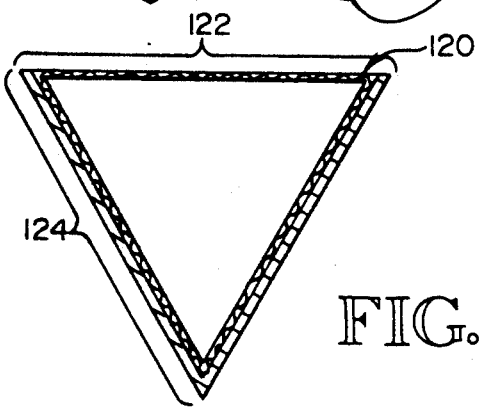
FIG. 9
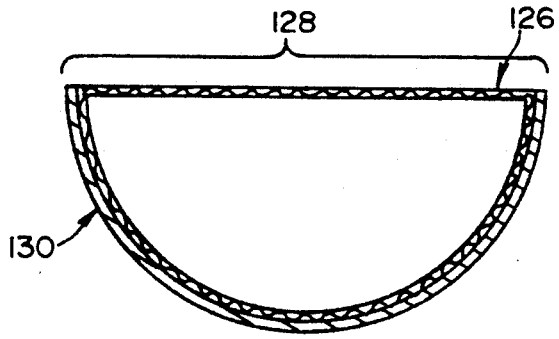
FIG. 9A

APPARATUS FOR FILTERING OPEN DRAINS

TECHNICAL FIELD

This invention relates to a method and apparatus for filtering open drains to prevent them from being clogged by debris. More particularly, this invention relates to a open drain filter which uses at least one elongated tube that is seamless and enclosed, and constructed from a plurality of strands of flexible, resilient, durable, corrosion resistant non-metallic material with the strands woven into a grid which makes up the fluid permeable body of the elongated tube.

BACKGROUND OF THE INVENTION

Troughs or open drains are an age old solution for removing and channeling excess waste fluids, a common example are rain gutters that are attached under the eaves of residential homes and other buildings. As long as open drains have been used there have been problems with them being partially or completely clogged either by debris contained in fluid carried by the open trough or debris simply settling in the open trough or both. Again, referring to the rain gutter example, rain water coming off the roof of a house may contain leaves, small branches, pine needles, roofing material, etc. which can clog the rain gutter, or leaves from trees may simply collect in the gutter as they fall from trees. The clogging problem is especially acute where the open trough feeds into a closed pipe such as a rain gutter down spout.

Attempts to remedy these problems have had mixed success. One of the apparently simplest solution is to simply suspend a screening material across the open portion of the effected trough. There are problems with permanently attaching the material on either side of the open drain. The weight of debris accumulating atop a screen suspended across an open trough can cause the screen to pull away from the suspension points if they are not sufficiently strong. At the same time in an application such as rain gutters on a building, the weight of any screen attachment system and its cost, both in terms of material and labor to implement an attachment system for a screen, need to be minimized.

In addition, the screening material must be such that it readily admits the water into the trough without itself being clogged by the debris. If the screening material is insufficiently permeable to the fluids, it will have the partial effect of diverting not only the debris from the open drain, but also directing the fluid from the open drain. If the screen material has a high permeability achieved by having large openings, there is the risk that it will not sufficiently perform its filter function and the open drain will become plugged.

Some other earlier efforts at alleviating the clogging problem have attempted to use screening material suspended over a separate frame which in turn is placed over its open trough. In such devices, the separate frame provides sufficient structural strength to prevent a collapse of the screening material from the weight of debris. While in some ways more effective than a flat screen suspended across an open drain, the use of a separate frame significantly increases the weight of the device, as well as the cost and complexity of assembly of the device.

Other approaches to solve the clogging problem use screening devices which are inserted into the open drain. As with a screen covering the top of the open drain, the screening device inserted within the open drain must balance permeability to the fluid against the filtering function to keep debris out of the open drain to prevent clogging. Also, it is important that the screen inserts have sufficient structural strength to prevent them from collapsing under the weight of the debris which would render them at best no better than the open drain alone and might actually contribute to the clogging problem.

Some inserts have used a metal mesh as a screening material to provide sufficient strength to the screen insert. Metal screen materials present problems with weight, cost, and fabrication for particular applications such as corners in the open drain. Also, since metal screening material is not generally resilient, if the screen insert is collapsed, it must be replaced.

Other screen insert devices have used solid porous material such as polyurethane foam in an attempt to address some of the problems with a metallic screen insert. These materials however are not sufficiently permeable to fluids and are therefore unable to effectively filter higher volumes of fluid, such as might be encountered by rain gutters in a rainstorm. In addition, many of these solid porous materials lack sufficient structural strength and require either additional structural supports to maintain their shape and position, or increased thickness which amplifies the problems of fluid flow.

As seen from the above discussion, there are a number of desirable characteristics for effective filters for troughs or open drains. It would be desirable to have an open drain filter which effectively filters debris from excess or waste fluids while allowing the fluid to pass relatively unobstructed. It also would be desirable to have an open drain filter which is lightweight, while at the same time having sufficient structural strength to prevent its collapse from the weight of accumulated debris. Further, it would be desirable to have an open drain filter that could be quickly and efficiently installed in new and already existing open drain systems without requiring special fittings or tools for the installation or fitting. In addition, it would be desirable to have an open drain filter that was both resilient, durable and corrosion resistant to minimize the need for replacement and repair.

While the discussion herein relates to a method and apparatus for open drain filters, it is not intended that the invention be limited to this situation. It will be obvious from the description that follows that the present invention will be useful in other applications with problems, to those described herein.

DISCLOSURE OF THE INVENTION

It is an object of the present invention to provide an open drain filter which can effectively filter debris from waste and excess fluid while allowing the fluid itself to pass relatively unobstructed.

It is also an object of the present invention to provide an open drain filter which can be used with and installed in both new and existing open drain systems without using special tools.

It is a further object of the present invention to provide an open drain filter which is relatively lightweight while at the same time has sufficient structural strength without use of separate structural supports to prevent its collapse under the weight of accumulated debris.

It is an additional object of the present invention to provide an open drain filter that is resilient, durable, and corrosion resistent to minimize the need for maintenance or replacement of the filter.

It is yet another object of the present invention to provide a method of making and installing an open drain filter in an existing open drain system.

It is an additional object of the present invention to provide an open drain filter kit so that as the open drain system is installed, an effective filter will already be in place in the open drain system.

The present invention achieves these and other objectives which will become apparent from the description that follows by providing at least one elongated tube which is seamless and enclosed except at its ends. The tube is constructed from a plurality of strands of flexible, resilient, durable, corrosion resistent, nonmetallic material. The plurality of strands are woven together to form a grid that makes up the sides of the elongated tube with the sides having sufficient structural strength to support debris that accumulates atop the elongated tube without the use of separate support devices. The elongated tube sides are substantially permeable to fluids such as rain water, while providing a filter function against debris such as leaves, twigs, etc. An affixing system is also provided w;hich allows the elongated tubes to be removably affixable within an open drain.

In an alternative preferred embodiment of the present invention, at least one elongated tube constructed by weaving together a plurality of strands as described in the above embodiment is used. In this embodiment, the grid formed from the woven strands has a substantially regular pattern. This grid has a plurality of apertures arrayed substantially uniformly throughout the sides of each of the elongated tubes, and further has relatively high structural strength.

In another alternative preferred embodiment, an elongated tube as described in above embodiments has a lateral cross section which has a rectangular shape. The affixing system in this embodiment uses the fact that the dimensions of lateral cross sections of the elongated tube are slightly larger than the corresponding dimensions of the open drain into which the tube is to be inserted. Thus, when the elongated tube is inserted into the open drain the walls of the elongated tube are slightly compressed to create frictional drag between the elongated tube and the inner surface of the open drain, thereby holding the elongated tube in place in the open drain.

In yet another alternative preferred embodiment of the present invention, a kit is provided which uses at least one elongated tube as described in the above embodiment. The elongated tube is inserted into an open drain such as a rain gutter as the open drain is being manufactured or immediately thereafter. The kit has an open drain with the enclosed elongated tube already inserted within them, so that when the open drain, such as a rain gutter, is installed, the filtering system is already in place and a separate filter does not have to be placed within the open drain at some later installation.

In an additional alternative preferred embodiment of the present invention, an elongated tube constructed from a plurality of strands as described in the above embodiments is used. In this embodiment, the affixing system uses a separate snap lock mechanism to hold the elongated tube in place.

DETAILED DESCRIPTION OF THE DRAWINGS

FIG. 7 is a perspective view of a fourth alternative preferred embodiment constructed in accordance with the present invention.

FIG. 8 is a perspective view of a fifth alternative preferred embodiment constructed in accordance with the present invention.

FIG. 9 is a cross section of a sixth alternative preferred embodiment constructed in accordance with the present invention.

FIG. 9A is a cross section of a seventh alternative preferred embodiment constructed in accordance with the present invention.

DETAILED DESCRIPTION OF THE PREFERRED EMBODIMENTS

Figure 1:
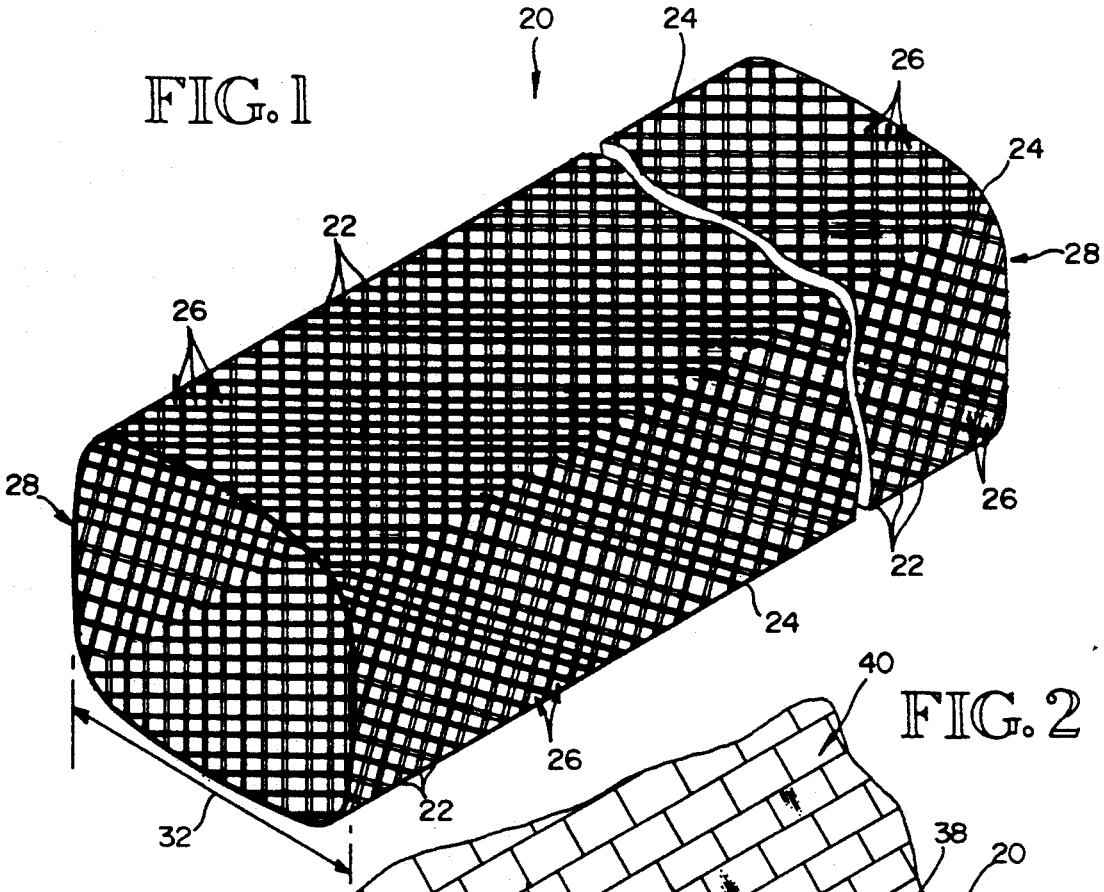
FIG. 1 is a perspective view of a preferred embodiment constructed in accordance with the present invention.

With reference to FIG. 1, an elongated tube 20 is shown. The elongated tube in this embodiment is made up of a plurality of individual strands 22 which are woven together into a substantially regular grid which makes up the sides 24 of the elongated tube. Interspersed throughout the tube sides of the grids are a plurality of apertures 26 which are formed by the strands and are arrayed regularly the entire elongated tube. The apertures are created by the gaps between the individual strands. The resulting structure is seamless elongated tube which is substantially enclosed with the exception of its ends 28 which are open. Although enclosed, the elongated tube is fluid permeable due to the aperture.

The strands 22 making up the elongated tube 20 can be produced from a variety of materials so long as the materials have certain characteristics which will result in a usable tube when the strands are woven together. The strands must be produced from a material that is substantially flexible, resilient, durable, corrosion resistant, and non-metallic. These features result in a structure that can be bent, distorted and collapsed, and yet restored to the original desired shape, thus eliminating one common cause of replacement of prior devices.

Similarly, a durable, corrosion resistant material extends the life of the filter, thus reducing one other possible cost of replacement. The material also should be as lightweight as possible without undo sacrifice of structural strength.

Success has been had using high density polyethelyne, which is a common industrial plastic well known to those skilled in the art. Material used for creating the strands 22 can contain a substantial percentage of recycled materials, thereby reducing the need for new material to be produced. Also, additives can be used to increase the ultraviolet resistance of the elongated tubes. Other materials having the desired properties are well known to those skilled in the art. They can include polyurethane, ABS, polyvinyl chloride and other plastics. Where a more rigid structure is desired and less flexibility can be tolerated, strands can possibly be produced from materials containing fiberglass or Kevlar®.

The individual strands 22 can be joined together in a number of ways. An efficient way to join the strands together is simply to press them together after the elongated tube 20 has been formed and the strands are still warm. The strands also can be welded together sonically or thermally, or fixed together by an adhesive.

Figure 2:
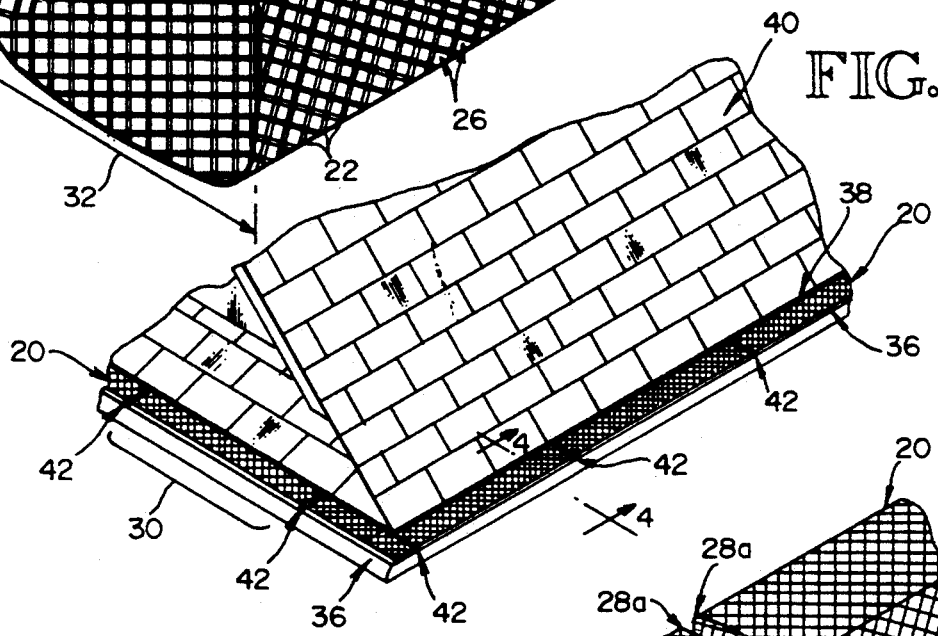
FIG. 2 is an environmental view of a preferred embodiment constructed in accordance with the present invention.
Figure 4:
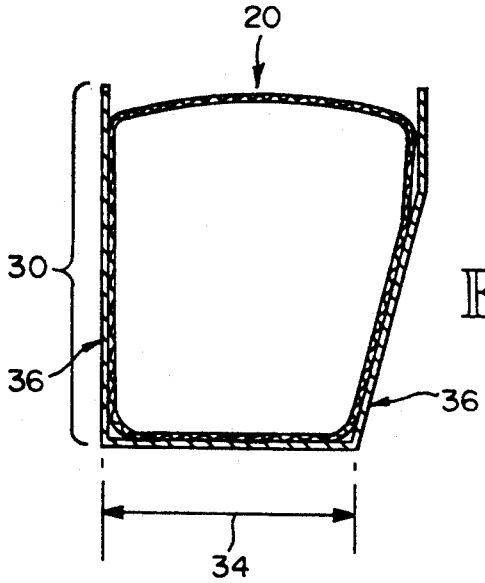
FIG. 4 is a cross section of a preferred embodiment constructed in accordance with the present invention taken along lines 4—4 in FIG. 2.

As shown in FIGS. 2 and 4, sections of the elongated tube 20 are placed within a trough or open drain, in this case, a rain gutter 30. The width 32 of the elongated tube is slightly wider than the rain gutter width 34. When the elongated tube is pressed into the rain gutter, the elongated tube sides 26 which are placed between the rain gutter sides 36 gradually deform as the elongated tube is pressed into the rain gutter. Since the elongated tube is flexible and resilient, it can be squeezed into the rain gutter without structural damage. At the same time, the compressed tube sides exert an outward force to create a frictional drag between the tube sides and the rain gutter sides. This enables the elongated tube to be affixed within the rain gutter without resorting to any external structure and at the same time allows elongated tubes to be removed if desired.

Figure 2A:
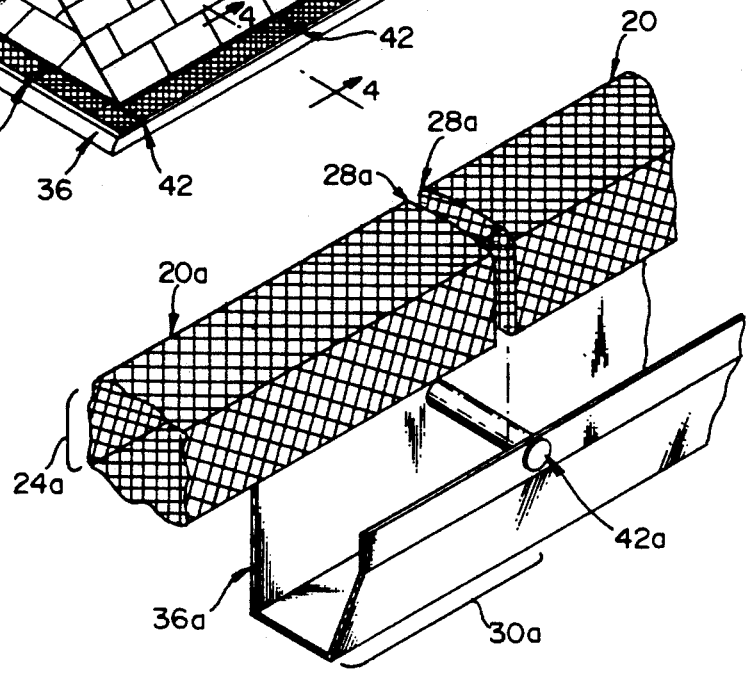
FIG. 2A is a partial perspective view of a preferred embodiment constructed in accordance with the present invention.
Figure 2B:
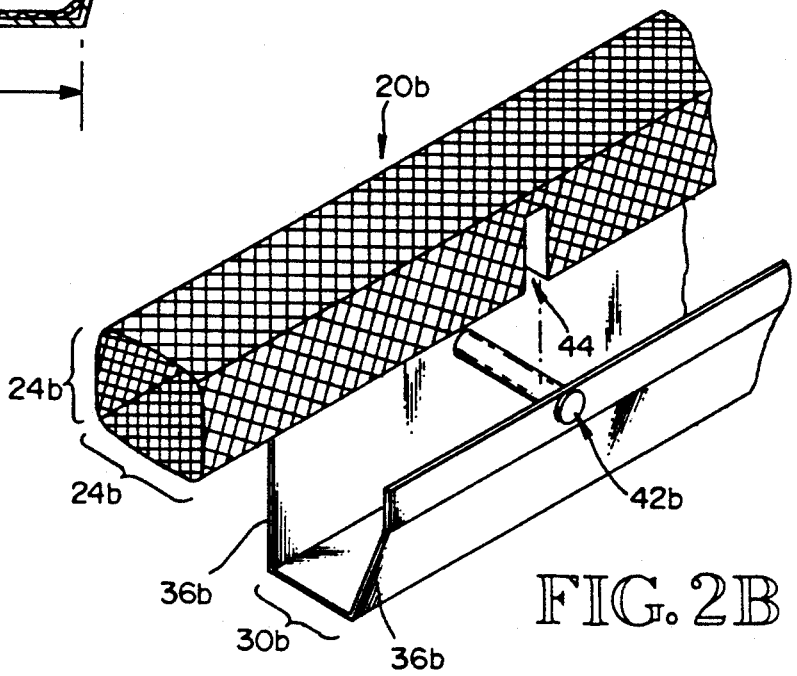
FIG. 2B is a partial perspective view of an alternative preferred embodiment constructed in accordance with the present invention.

A typical rain gutter using two alternative preferred embodiments in accordance with the present invention are shown in FIGS. 2A–2B. As shown in FIG. 2, the rain gutter 30 is attached to the edge 38 of the roof 40. A common way to attach the rain gutter is to use gutter nails 42. Gutter nails are commonly placed at regular intervals, for example, every two or four feet. As shown in FIG. 2A, in an effort to increase the ease of installation, the elongated tube 20*a* can be manufactured in correspondingly regular lengths, (i.e., two or four feet). This enables the elongated tube ends 28*a* to slide on either side of the gutter nails 42*a* into the gutter 30*a*. The elongated tube also can be easily cut to the desired length.

Another method of installing the elongated tubes 20*b* with rain gutters 30*b* held in place by gutter nails 42*b* is illustrated in FIG. 2B. Here, a mounting slot 44 is cut in three sides 24*b* of the elongated tube. The mounting slots are placed over the gutter nails and the elongated tube is fitted down into the gutter so that the slots straddle the rain gutter nails. This way of installing the elongated tubes allows at least one common side to continue for the length of the elongated tube which may provide more structural strength if that is desired. Also the method of cutting mounting slots for installation can be used where intervals of the gutter nails are irregular. Cutting the elongated tube is relatively easy since the tubing is constructed of non-metallic material.

Whether premeasured elongated tubes or mounting slots 44 cut into the tube are used, this further stabilizes the position of the installed elongated tube, and with the friction between the gutter sides 36, 36*a*, 36*b* and the elongated tube sides 24, 24*a*, 24*b*, enables an affixing system to be used that does not require separate parts.

Figure 3A:
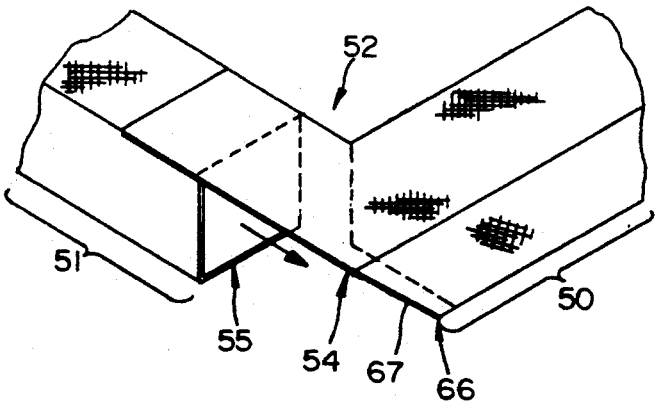
FIG. 3A is a partial perspective view of a second alternative preferred embodiment constructed in accordance with the present invention.
Figure 3:
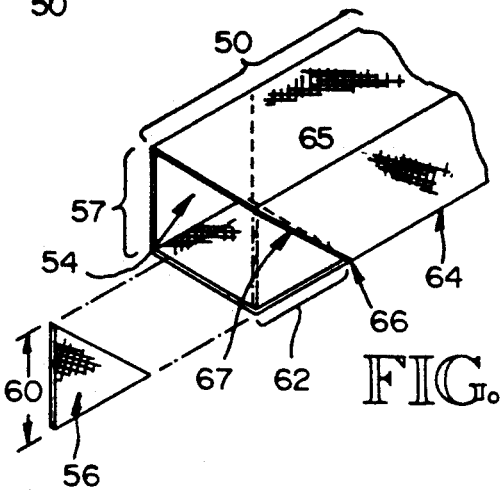
FIG. 3 is a partial perspective view of a second alternative preferred embodiment constructed in accordance with the present invention.

Another aspect of installing a preferred embodiment of the present invention using first and second elongated tubes 50 and 51 is illustrated in FIGS. 3 and 3*a*. This aspect to the invention as shown is to enable the elongated tube to be installed in a corner of an open drain such as a rain gutter. To provide a filter for the corner of the open drain, a upper flap 52 is created from one of two abutting elongated tubes whose ends 54 and 55 meet at the open drain corner.

The upper flap is created by first cutting a triangular notch 56 from the elongated tube side 58 proximate the tube end. The height 60 of the triangular notch should be substantially equal to the height of the corresponding elongated tube side. The base 62 of the triangular notch should extend inward from the elongated tube end along the edge 64 between the elongated tube side that will be downwardly oriented and the tube side from which the notch will be cut.

After the triangular notch 56 has been removed, a cut 65 is created along the downwardly oriented tube side and the elongated tube side opposite the elongated tube side from which the triangular notch was cut. The cut begins at the inward end 66 of a triangular notch base 62 and is made substantially parallel to the elongated tube end 54 as shown in detail in FIG. 3A. After the triangular notch has been cut and removed and the two three remaining elongated tube sides have been cut, the upper flap 52 is created. This upper flap extends outward at approximately 90° from the elongated tube and is attached firmly to the elongated tube by the remaining upwardly oriented tube sides.

After the first elongated tube 50 has been placed in the open drain, the upper flap 54 is lifted upward and the second elongated tube 51 can be slid into position until its abutting end 55 is proximate the nearest first elongated tube side. When is this position, the upper flap extends over the second elongated tube. The angled edge 67 serves to enable the first elongated tube to be placed proximate a side 36 of a rain gutter where the sides are frequently slanted inward as demonstrated in FIG. 4.

The second tube end 55 is not extended past a first elongated tube side 57 nearest it because this would result in a stream being introduced laterally within the rain gutter which could cause clogging. By extending the second elongated tube end no farther than the first elongated tube side nearest it, a substantially open passage is left through the rain gutter corner while maintaining the screen filter function of the invention.

Figure 5:
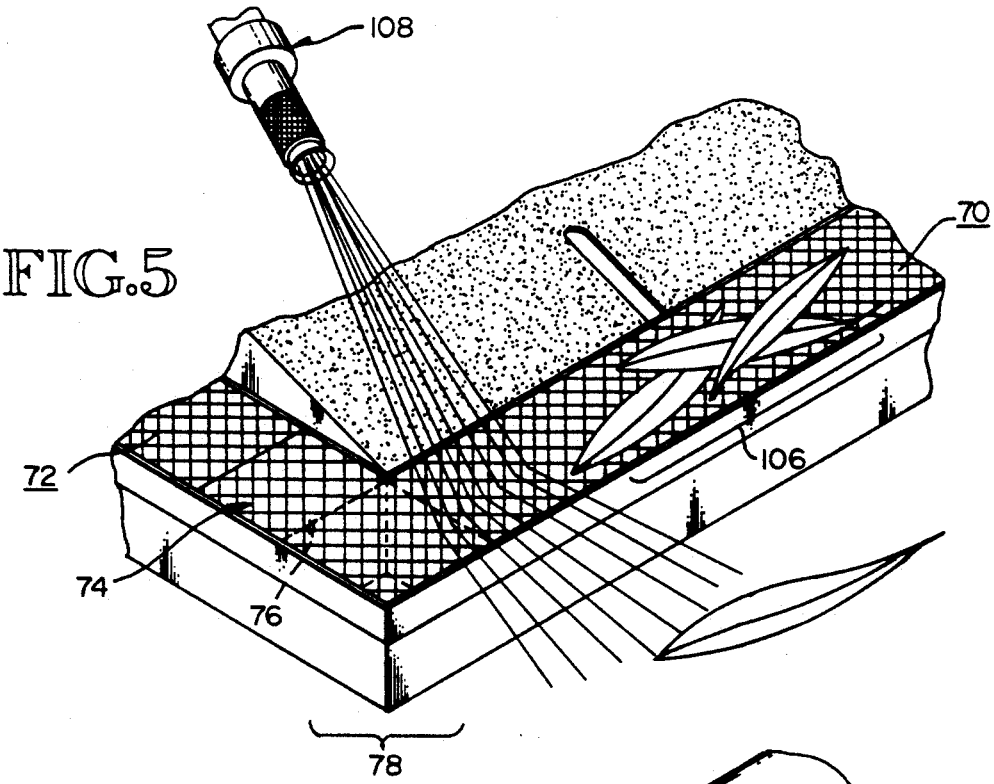
FIG. 5 is a partial environmental view of a preferred embodiment constructed in accordance with the present invention.

The assembled open drain filter corner is shown in FIG. 5 with a first elongated tube 70, a second elongated tube 72, upper flap 74, and second elongated tube end 76 underneath the upper flap, all located in rain gutter 78. It should be noted that this embodiment can be created using only a knife or shears, as can the mounting slots 44 in FIG. 2B.

The triangular notch 56 does not have to be removed from the upper flap 52. A downwardly angle cut can be made to create angled edge 67 without making a cut along the base 62 of the triangular notch. In this situation, the cut 65 is created along the downwardly oriented and opposite sides of the elongated tube as before. The only difference is that the triangular remains attached to that portion of the elongated tube that becomes the upper flap.

The elongated tubes as discussed in the above embodiment and illustrated in the accompanying figures have substantially rectangular grids oriented diagonally with respect to the length of the elongated tube, for example, elongated tube 20, with woven strands 22. While this is clearly a successful embodiment of the present invention, it is not the only possible construction of grid nor are there any specific requirements for spacing of individual strands 22 and the corresponding apertures 24 throughout the elongated tube sides.

The design and spacing of the individual strands into a group are dictated by two practical considerations. First, the grid making up the elongated tube must provide sufficient structural strength to enable the elongated tube to support the weight of any accumulated debris without employing any separate structural support. The overall structural strength of the elongated tube and hence the filter are determined by the design and spacing of strands in the grid together with the inherent strength of the materials used. As spacing between the strands is increased, the structural strength is decreased. At the same time, if a more rigid material is used to create the strands, the same structural strength can be achieved, but flexibility and resilience of the elongated tube may be lessened. The specific construction of an embodiment of the present invention is to be determined by the application.

The strand diameter size, for example, can vary from less than 0.01 inches to more than 0.25 inches. On the narrow end of the range little weight can be supported event with substantial grid structure. At the other end of the range, the strands can be so rigid that they can be bent or deformed. Success has been achieved with strands having diameters from 0.04 inches to 0.10 inches, although experimentation has shown that other sizes also are useful, depending on the application.

The diameter of the tubes are basically limited only by the desired application. For example, cross section sizes for rain gutter applications range from 2 inches to substantially more than 4.5 inches.

One successful method of creating the elongated tube is illustrated in FIG. 7. An extrusion machine 80 is used to create the individual strands 82 with die head 84. The individual strands coming out of disks 86 in the die head that are rotating in opposite directions. The rotating disks position the strands into a grid about a mandible 88. This grids becomes the elongated tube 90. The tube is run through a water bath 92 and fed through opposing rollers 94 and 96 which pinch the elongated tube to create the rectangular shape of the resulting elongated tube.

The spacing of the individual strands in the grid of the elongated tube are dictated by the speed with which the elongated tube is created from the extrusion machine and the die heads. If the elongated tube is pulled off the mandible at a higher rate then the spacing between the individual strands will be greater resulting in a lessening of structural strength. Similarly, if the elongated tube is pulled from the mandible at a slower rate, the individual strands will be closer together and the structural strength will be greater. Any number of commercially available extrusion machines and dieheads can be used to create the elongated tube herein.

Figure 6:
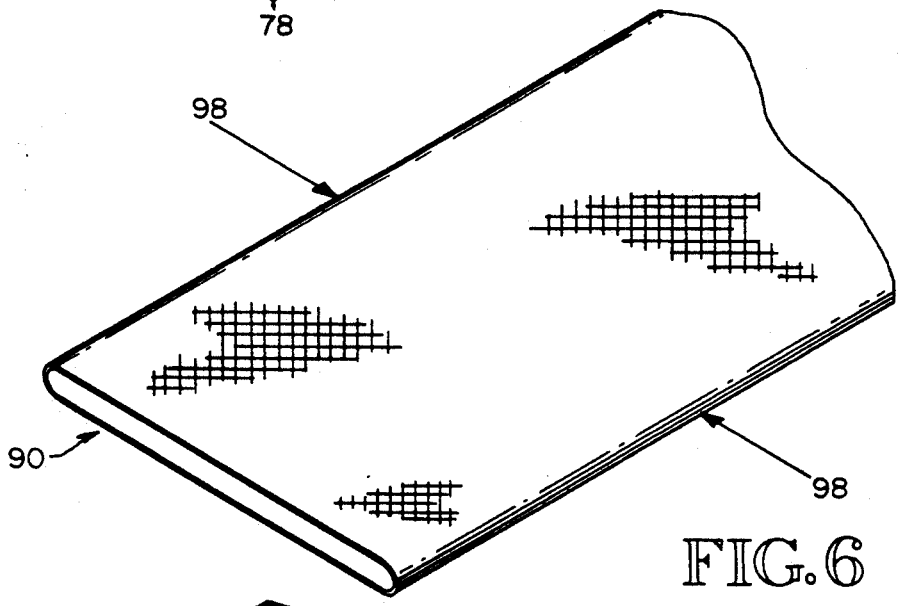
FIG. 6 is a partial perspective view of a third alternative preferred embodiment constructed in accordance with the present invention.
Figure 6A:
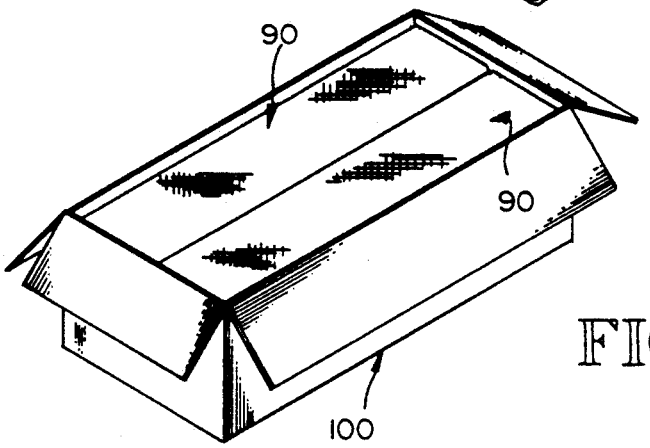
FIG. 6A is a perspective view of a third alternative preferred embodiment constructed in accordance with the present invention.

After the elongated tube 90 has been created and cut into the desired length, the use of the flexible resilient material enables the elongated tube to be flattened along two opposing edges 98 for compact shipping as shown in FIG. 6. When collapsed, the elongated tubes can be transported in boxes in a shipping crate 100 as shown in FIG. 6*a*. Due to their light weight, even in a collapsed state, space requirements are a greater limitation than weight of the material for shipping the elongated tubes. When the packed, collapsed elongated tubes are received at the site at which they are to be installed, they are removed from the shipping box and by briefly squeezing the opposing edges 98 toward each other are returned to the original shape of the elongated tubes for use.

After the installation, which is discussed in detail above, the open drain filter will have a substantially, maintenance free, useful service life. Occasional removing of accumulated debris 106 by a water hose 108 in most instances will be sufficient, as shown in FIG. 5 since the filter and elongated tube creating the open drain filter substantially fills the open drain as illustrated in FIG. 4, cleaning is facilitated.

Another embodiment of the present invention is shown in FIG. 8. In this embodiment a kit is created by installing the elongated tube 110 into an open drain such as a rain gutter 112 as the open drain is created or immediately thereafter at the manufacturing site. The resulting kit 114 requires only a one-step installation and eliminates the need for a second installation of filtering material of the filter to the open drain after the open drain has been installed. The kit can be cut to predetermined lengths and packaged.

In the particular embodiment illustrated in FIG. 8, the kit can be created at the site where the gutter or open drain is to be installed. In this embodiment, a portable gutter 116 machine can be transported to the site of the installation where the rain gutter 112 can be created to the exact specifications needed for a particular installation are created is used. By combining the endless gutter machine and the pre-installing of the elongated tube 110 to create the open drain filter, the quick, efficient lightweight, durable gutter and filter system can be installed in one step. There are a number of commercially available machines, such as machines built by the Panther Co. In other applications, the elongated tube can be installed in rain gutters or other open drains at a manufacturing site and purchased preassembled at commercial outlets.

Although the above discussion deals primarily with elongated tubes that have cross sections with rectangular shape, there are no practical limitations in the cross sectional shape of the filtering possible as an invention. FIG. 9 shows an elongated tube 120 with a triangularly shaped cross section 122 for use in a specialized open drain 124. FIG. 9*a* illustrates an elongated tube 126 with a semi-circular cross section 128 for use in an open drain 130 that is also semi-circular. If desired, a semi-circular open drain can use an elongated tube with a circular cross section which would actually extend above the open drain to aid in the disbursing of debris (not shown). Such applications might be applicable for open drains in concrete floors and the like. Also, if the open drain were curved along its length, an elongated tube could be made curved along its length and still provide a functional open drain filter.

Regardless of the embodiment or combination of embodiments used, the present invention provides an efficient filter for troughs or open drains that is light weight, comparatively easy to install and which will prove to be extremely durable. Also, the filter can be installed and custom fit for specific applications using only a knife or shears, and no other tools or additional parts. These characteristics which minimize the costs to maintain and repair an open drain system can be especially important in such awkward applications as rain gutters on houses and other buildings.

INDUSTRIAL APPLICABILITY

This invention would be useful in any situation where it is desirable to have a filter for a trough or open drain that is light weight, efficient, economical to install and maintain, especially where durability is an issue.

In compliance with the statute, the invention has been described in language more or less specific as to structural features and processes. It is understood, however, that the invention is not limited to the specific features and processes shown, since the means of construction herein disclosed comprise preferred forms of putting the invention into effect.

The invention is, therefore, claimed in any of its forms or modifications within the legitimate and valid scope of the invention.

1. A gutter filter, comprising a plurality of interwoven, resilient plastic fibers positioned in a grid array and interconnected at intersections of the fibers so as to form an elongated, substantially cylindrical, seamless, resilient and substantially closed, perforated tube having two open ends, wherein the fibers define a grid surface having plurality of substantially radially directed apertures for passage of fluid therethrough, whereby the filter can be positioned in an elongated gutter so as to substantially allow passage of fluid through the grid surface and so as to substantially prevent passage of solid objects through the grid surface.

2. The filter of claim 1, including a second tube having one end positioned adjacent to an end of a first tube and the tubes being positioned substantially perpendicular to one another, wherein the tubes have a substantially rectangular cross-sectional shape and wherein the one end of the second tube has a rectangular, laterally extending flap cut from a bottom and side portion thereof positioned in an overlapping relationship with the adjacent end of the first tube so as to form a corner filter for a corner of a gutter.

3. The filter of claim 1, wherein the fibers have a thickness substantially in the range of 0.04"–0.10".

4. The filter of claim 3, wherein the perforated tube has a length in the range of 2'–4'.

5. The filter of claim 3, wherein the fibers are high density polyethylene material.

* * * * *